United States Patent [19]

Andersen et al.

[11] 4,250,867

[45] Feb. 17, 1981

[54] HEATING UNIT

[76] Inventors: John I. Andersen, Rte. 6. Box 66; Eugene L. Clayton, 508 S. 3500 E., both of Idaho Falls, Id. 83401

[21] Appl. No.: 839,031

[22] Filed: Oct. 3, 1977

[51] Int. Cl.[3] ..... F24B 7/04

[52] U.S. Cl. ..... 126/121; 126/66

[58] Field of Search ..... 126/121, 122, 131, 140, 126/61, 63, 66, 72; 237/51

[56] References Cited

U.S. PATENT DOCUMENTS

| | | | |
|---|---|---|---|
| 1,681,449 | 8/1928 | Walters | 126/121 |
| 2,743,720 | 5/1956 | Dollinger | 126/121 |
| 2,814,287 | 11/1957 | Shults | 126/140 |
| 3,981,292 | 9/1976 | Lilly et al. | 126/121 |
| 4,019,492 | 4/1977 | Rush | 126/121 |
| 4,059,090 | 11/1977 | Shaw | 126/121 |
| 4,089,320 | 5/1978 | Brown et al. | 126/121 |
| 4,092,976 | 6/1978 | Buckner | 126/121 |

FOREIGN PATENT DOCUMENTS

| | | | |
|---|---|---|---|
| 249608 | 2/1964 | Australia | 126/121 |

*Primary Examiner*—Albert J. Makay
*Assistant Examiner*—Harold Joyce
*Attorney, Agent, or Firm*—Criddle & Western

[57] ABSTRACT

A fireplace heater unit having outside air forced around and over the heater unit before being discharged from the bottom front of the unit.

5 Claims, 4 Drawing Figures

HEATING UNIT

BRIEF DESCRIPTION OF THE INVENTION

1. Field of the Invention

This invention relates to fireplace heaters having a heat collection jacket surrounding the combustion chamber and a thermostat-controlled fan to force air through the jacket and into a room.

2. Prior Art

Heating units for fireplaces are, of course, well known and in common use. Such units generally consist of a heat jacket built in or slid into the fireplace and they may use air from the room or air from outside the building for heating and circulation. Room air is generally used for combustion, and fans have been used to circulate the heated air. Both open and closed combustion chambers have been used in these devices.

To the best of my knowledge, however, there has not heretofore been available a fireplace heater unit that is adaptable for use as a built-in unit, a slide-in unit or a free-standing unit and that is adaptable to utilize room air or air from outside the building for heating and circulation and for combustion as required for the use made of the unit.

Structures utilizing fixed air flow arrangements have been proposed in the past. U.S. Pat. Nos. 2,183,458, 1,670,034, 1,681,995, 1,030,002, 394,653, and 2,161,723, for example, each disclose a heating unit for a fireplace that uses a flow of cold outside air into the heating chamber, with the air being circulated into the room by gravity or by use of a fan.

U.S. Pat. Nos. 1,747,259, 2,642,859, and 2,134,935, each disclose the use of a built-in or slide-in heating unit for a fireplace that uses room air for combustion, heating and circulation.

U.S. Pat. No. 1,681,995 discloses a heat unit built into a fireplace that heats both outside and inside air in a closed-combustion chamber having transparent doors. Room air is used for combustion. The flow of air through the unit is created by gravity.

U.S. Pat. No. 2,642,859 discloses a heating unit for a fireplace that circulates inside air and that will slide into a conventional fireplace or that may be built-in.

U.S. Pat. No. 2,258,682 discloses the use of outside air for combustion, but this device relates generally to forced-air furnace systems and not fireplaces.

SUMMARY OF THE INVENTION

It is a principle object of the present invention to provide a fireplace heater unit that may be built into a fireplace, that will slide into an existing fireplace opening, or that may be used as a free-standing fireplace.

Other objects are to provide an efficient fireplace heater unit that may be adapted to use either outside or inside room air for room heating and combustion and which uses a variable speed, thermostatically controlled fan for positive delivery of the air.

Still another object is to provide a fireplace heater with a closed combustion chamber that prevents excessive chimney draft and that provides more controlled burning of fuel, the chamber being provided with transparent doors to allow visibility of the flame and to maintain the aesthetic characteristics of a conventional open fireplace.

Yet other objects are to provide a fireplace heater that when used with outside air for heating and combustion, pressurizes a room or a house to prevent cold air from entering through cracks around doors and windows and wherein the combustion chamber is sealed so that closing of the chimney damper is unnecessary when the fireplace is not in use to prevent loss of heat from the room through the chimney.

Principal features of the present invention in a fireplace heater unit include a box that is generally of rectangular configuration with sides, back, bottom, top and partially open front wall. At the top of the box and a short distance from the front wall, an opening appears and extends to the back of the box and across to each side to form a chimney opening. The size of the box and the shape can be varied according to the individual requirements for each fireplace. The box may contain the usual firebox openings for clean-out purposes found in conventional fireplaces.

An air chamber is formed outside the box, at the back thereof and the air chamber is associated with an intake duct near the bottom and a series of tubes near the top. The intake duct is vented to the outside of the building and an electric fan is used to force air through the duct into the back air chamber. At the top of the box and extending across the chimney opening are a series of open tubes. The tubes are associated with the back air chamber at one end and are associated with a front air chamber at the opposite end. The chambers are sealed off from the chimney opening and the tubes provide a passage across the chimney opening for air between the front and back chambers. Sides of the chimney opening project vertically and then gradually converge to form a chimney duct corresponding in size to the chimneys generally found in conventional fireplaces. The front air chamber is open to air chambers at each side of the box, with said side chambers covering nearly the entire side of the box. The side air chambers are associated with a bottom-air chamber which extends across the full bottom of the box, except where it is blocked out for openings for clean-out purposes, and opens into the room near the front of the box. Air is forced through the intake duct into the back air chamber and into the tubes at the top. The air is forced through the tubes to the front air chamber, down around the sides of the box into the bottom air chamber and out the bottom opening near the front of the box. The series of air chambers and tubes form a heat jacket wherein air is heated and blown out into the room for room heating purposes.

A series of small holes along the front of the box at the top and the sides provide air inlets into the box from the air chambers. Deflectors inside the box direct the incoming air away from the front of the box. The open front of the box is closed with transparent doors of a heat resistant type. The air entering the box from the small holes from the air chambers acts to keep smoke away from the doors of the box and also provides air from combustion. A panel extends across the front of the box near the bottom, with a series of holes opening into the box for combustion air.

A heat-sensing device in the air chambers acts to shut-off the fan if the heat jacket cools too much and turns it on when a proper temperature is reached. A conventional room thermostat is also preferably used in series with the fan to operate the fan within a pre-set range of room temperatures.

As the fireplace heater is used the fan operates to create a higher air pressure in the building than exists outside the building. This acts to reverse the normal process wherein cold air is drawn into the house through cracks around doors and windows by the normal draft up the chimney of a fireplace and makes the fireplace heater of the present invention considerably more efficient than a conventional fireplace in heating a room or building.

The fan may also be manually operated to draw cool air into the house when desired, for example, in summer time, when no fire is present in the combustion chamber.

Additional objects and features of the invention will become apparent from the following detailed description taken, together with the accompanying drawings.

THE DRAWINGS

In the drawings:

FIG. 1 is a perspective view of the fireplace heater unit of the present invention, taken from slightly above and at one corner and with the outer top and sidewalls removed to show the air chambers that are formed within a heat jacket surrounding the combustion chamber;

FIG. 2, a longitudinal vertical sectional view taken on the line 2—2 of FIG. 1;

FIG. 3, a transverse vertical sectional view taken on the line 3—3 of FIG. 1; and FIG. 4, a schematic diagram showing the unit including a room thermostat control.

DETAILED DESCRIPTION

Figure 1:
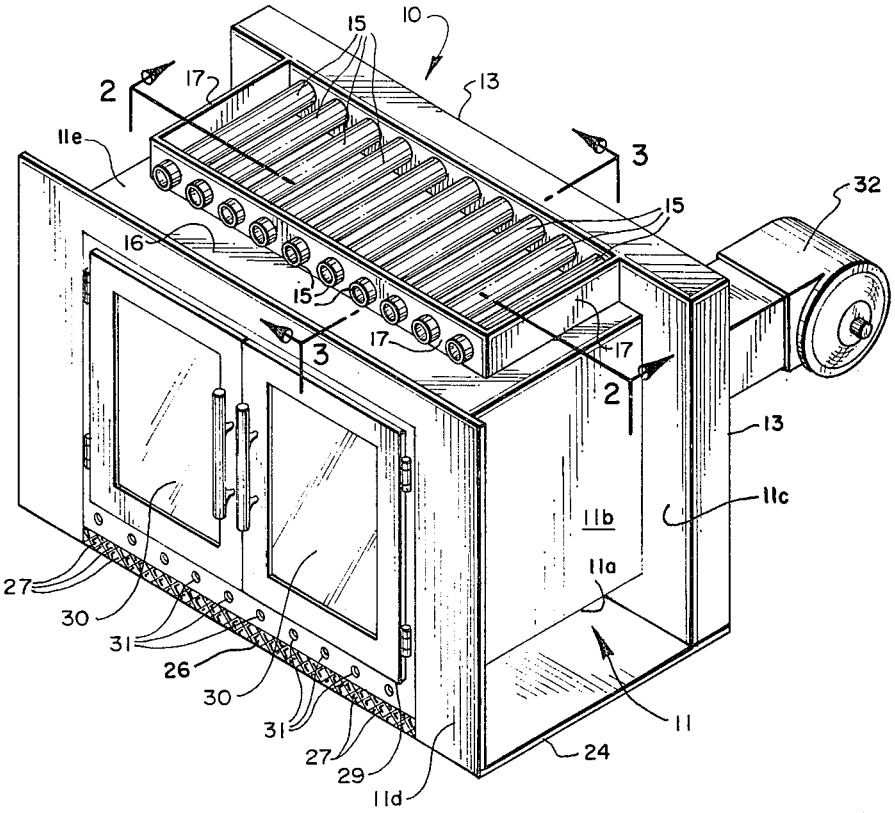
Figure 2:
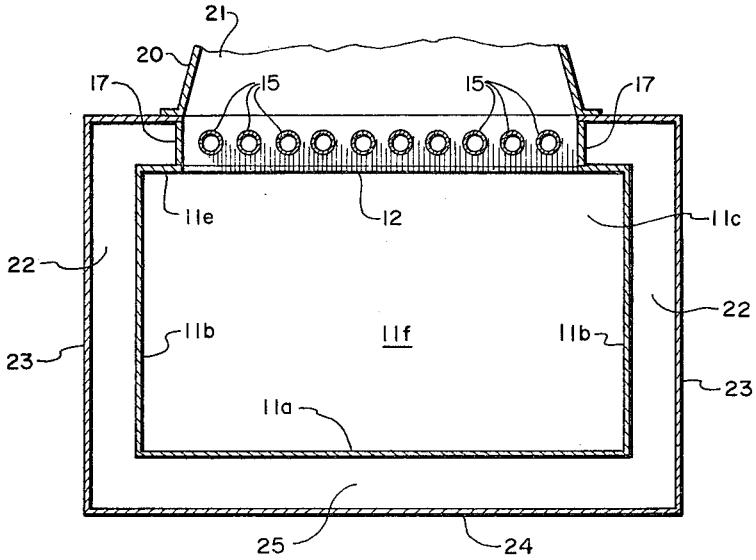
Figure 3:
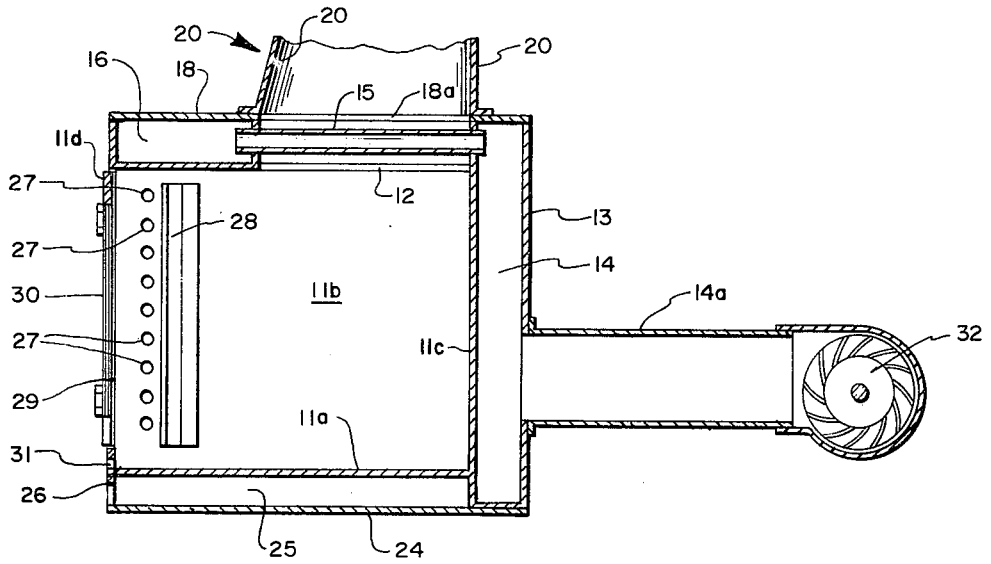

Referring now to the drawings:

In the illustrated preferred embodiment, the fireplace heater unit 10 of the present invention includes a box 11, of generally rectangular shape. As shown, the box has a bottom 11*a*, upstanding, spaced apart sidewalls 11*b*; a back wall 11*c*; a partially open front wall 11*ad*; and a partially open top 11*e* with the sidewalls, back wall and front wall interconnected by the bottom and top. The box 11, is shaped to fit the opening of a conventional fireplace and, so constructed, it may be built into a fireplace opening, may slide into a pre-existing fireplace, or may be used as part of a free-standing fireplace. The box may contain openings for clean-out purposes, the same as are generally provided in fireboxes of conventional fireplaces. The inside of the box forms a combustion chamber 11*f*.

A short distance from the front wall 11*d* and at the top 11*e* an opening 12 extends to the back wall 11*c* and to each sidewall 11*b*, to form a chimney opening.

An outer wall 13 cooperates with the back wall 11*c* of the box 11 to form a back air chamber 14. An intake duct 14*a* having its intake outside of the building in which the unit is used, is connected into the back air chamber. Slightly above the top 11*c*, and extending across the chimney opening 12,, on the line 2—2 of FIG. 1, are a series of tubes 15. The tubes 15 each open at one end into the back air chamber 14 and at the other end into a front air chamber 16. The tubes 15 are held in place by vertical projections 17 that extend from the top 11*e* of the box and around the chimney opening 12 and that seal the front air chamber from the chimney opening.

The front wall 11*d* extends vertically a short distance above the top 11*e* to the same height as the vertical projections 17. An outer top wall 18 rests on top of the vertical projections 17 and the vertical extension of the front wall 11*d*. The outer top wall 18 has a hole 18*a* therethrough to form a chimney opening. Wall 18 seals the front air chamber 16 and the back air chamber 13 from the chimney opening 12, thereby insuring that combustion gases do not intermix with heating air. However, the combustion gases flowing up around the tubes 15 heat air moving through the tubes 15.

At the edges of the chimney opening 12 sides of a duct 20 converge upwardly to form a chimney duct 21.

The front air chamber 16 opens at opposite sides into side air chambers 22 formed between outer sidewalls, i.e. the inner sidewalls 23 of a fireplace and sidewalls 11*b*. The outer sidewalls 23 are interconnected with an outer bottom wall 24, i.e. the inner bottom wall of a fireplace which, with the bottom 1*a* of box 11, forms a bottom air chamber 25. a decorative grate covered bottom opening 26 extends through the front wall lid to provide a distribution opening through which heated air is forced into the room containing the heater unit from chamber 25.

The walls of the front air chamber 16 and the side air chambers 22 have openings 27 therethrough opening into the box 11 near the front wall lid. Deflectors 28 are angled inwardly toward the interior of the box adjacent to the holes 27. The air chambers thus form a heat jacket for transfer of heat to air within the chambers.

The front wall lid has an opening 29 formed therein and transparent doors 30 are fitted to close the opening. Near the bottom of the front wall lid a series of holes 31 through the wall open into the combustion chamber 11*f*. The holes 31 provide openings for air from the room to enter the combustion chamber to provide at least the bulk of the air needed for efficient combustion purposes.

Figure 4:
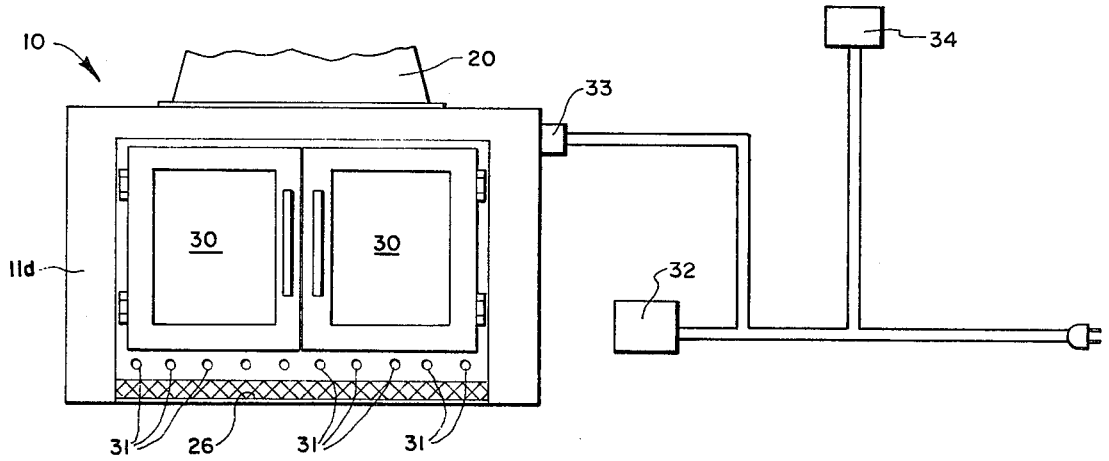

Air is forced into the intake duct 14*a* by an electric fan 32. The fan may be controlled manually and by a heat-sensing device 33, FIG. 4, within the heat jacket which operates to turn the fan on or off within a desired temperature range. A room thermostat 34 is also connected in series with the device 37 to control the fan and to operate it within a desired range of room temperatures.

In operation, fuel is burned in the combustion chamber, thereby heating the heat jacket surrounding the combustion chamber and the air therein. The pressurized air flowing through the heat jacket is heated and is used to heat the room or building. As air flows through the front and side air chambers, a portion thereof passes through the holes 27 into the combustion chamber. As it enters the combustion chamber it is directed by the deflectors 28 into the combustion chamber and across the transparent doors. The air entering the front of the combustion chamber, next to the doors helps to keep smoke, and soot particles away from the doors and helps keep the doors clean as well as providing additional air for combustion purposes.

Since air for heating is obtained from outside the building, the system operates to pressurize the room and building to prevent cold air from entering through cracks around doors and windows. This renders the fireplace heater much more efficient than other units which normally draw cold air into the room containing a fireplace in order to provide air for combustion purposes.

Use of a closed combustion chamber keeps the chimney draft from pulling cold air into the room through cracks around doors or windows and then up the chimney. The closed combustion chamber also provides more efficient heating of the heat jacket, and the transparent doors still maintain the aesthetic characteristics of a conventional fireplace.

With the fireplace unit 10 herein described, it will be apparent that the walls of an existing or constructed fireplace may serve in place of the top side and bottom walls of an independent, free-standing unit.

Although a preferred form of my invention has been herein disclosed, it is to be understood that the present disclosure is made by way of example and that variations are possible without departing from the subject matter coming within the scope of the following claims, which subject matter we regard as our invention.

We claim:

1. A fireplace heater unit comprising a box having a bottom, spaced upright side walls, a back wall interconnecting the side walls, a front wall interconnecting the side walls and having a door and air inlet openings therethrough, and a top interconnecting said side, back and front walls and having a chimney opening therethrough, whereby the interior of said box will serve as a combustion chamber;

a back outer wall forming a back chamber with the back wall of the box;

an air inlet duct connected from atmosphere into the back chamber;

means for forcing pressurized air through the air inlet duct and into the back chamber;

conduit means extending from the back chamber over the chimney opening through the top;

an outer top wall spaced from the top and forming a front chamber with the top, said conduit means extending into said front chamber;

means sealing said front chamber from the chimney opening;

at least one outer side wall forming a side chamber with a side wall of the box, said side chamber being connected to the front chamber and separated from the back chamber;

an outer bottom wall forming a bottom air chamber with the bottom and the front wall of the box, said bottom air chamber being open to each said side chamber and separated from the back chamber, and having openings from the bottom chamber through the front wall whereby heated air in the bottom chamber is forced through said openings;

said means, for forcing pressurized air including a blower for directing atmospheric air against the back wall of the box, then over the top of the box, then along at least one side wall of the box, then beneath the box and out from beneath the front wall of the box; and door means connected to the front wall and adapted to close the door opening therein.

2. A fireplace heater unit as in claim 1, further including holes through each side wall of the box adjacent to the front wall thereof; and deflector mans inside the box directing air entering the box via the holes through the side walls across the door means, and wherein at least a portion of said door means is transparent.

3. A fireplace heater unit as in claim 2, further including a temperature responsive control means in an air chamber; and a thermostat, said temperature responsive control means and said thermostat being connected to control operation of the means for pressurizing air through the air inlet duct.

4. A fireplace heater unit as in claim 3, wherein the means for forcing pressurized air through the air inlet duct comprises an electric fan.

5. A fireplace heater unit as in claim 4, wherein a pair of side chambers are provided, whereby air from opposite side chambers is directed across the door means.

* * * * *